US009562410B2

(12) United States Patent
Halfmann

(10) Patent No.: US 9,562,410 B2
(45) Date of Patent: Feb. 7, 2017

(54) INCREASED LOAD BEARING THICKNESS FOR ANCHORING SLIP

(71) Applicant: Baker Hughes Incorporated, Houston, TX (US)

(72) Inventor: Eric Halfmann, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 501 days.

(21) Appl. No.: 14/067,405

(22) Filed: Oct. 30, 2013

(65) Prior Publication Data

US 2015/0114620 A1 Apr. 30, 2015

(51) Int. Cl.
*E21B 33/129* (2006.01)
*E21B 23/01* (2006.01)

(52) U.S. Cl.
CPC ..... *E21B 23/01* (2013.01); *E21B 33/1291* (2013.01); *E21B 33/1292* (2013.01); *E21B 33/1293* (2013.01)

(58) Field of Classification Search
CPC E21B 33/129; E21B 33/1291; E21B 33/1292; E21B 33/1293; E21B 23/01
See application file for complete search history.

(56) References Cited

U.S. PATENT DOCUMENTS 2,345,873 A * 4/1944 Hart ..... E21B 33/1293 166/134
2,546,377 A * 3/1951 Turechek ..... E21B 33/1293 166/134
2,901,046 A * 8/1959 Webber ..... E21B 33/1292 166/134
3,420,306 A 1/1969 Brown
3,530,934 A 9/1970 Kisling
3,631,925 A * 1/1972 Nutter ..... E21B 33/1293 166/123
3,631,926 A * 1/1972 Young ..... E21B 33/1293 166/123
7,431,096 B2 10/2008 Fay
2005/0230108 A1 10/2005 Mackenzie et al.
2006/0278404 A1 12/2006 Fay
(Continued)

FOREIGN PATENT DOCUMENTS

WO 2012024041 A1 2/2012

*Primary Examiner* — Giovanna C Wright
(74) *Attorney, Agent, or Firm* — Steve Rosenblatt

(57) ABSTRACT

A slip design has segments that move relatively axially before moving in tandem up a ramp for radial extension. Due to the fact of the relative movement the segments interlock due to their geometric configuration or their surface treatment such that at the conclusion of such relative movement the load carrying thickness is effectively increased. The extended position minimizes radial extension of the slips for a smaller tool drift dimension while still allowing the needed radial extension and actually extending the radial reach of the slip assembly. The segment can have triangular or trapezoidal tapered interfaces that provide bearing areas between slip segments and adjacent spacer segment. Alternatively, the slips segments can have opposing wickers so that after riding up an underlying support member can interact with that member for load transfer. The supporting members can also be secured to an underlying mandrel for further load transfer.

20 Claims, 5 Drawing Sheets

(56) References Cited

U.S. PATENT DOCUMENTS

| | | | | |
|---|---|---|---|---|
| 2009/0114398 | A1* | 5/2009 | Buytaert | E21B 33/1291 166/380 |
| 2012/0037381 | A1 | 2/2012 | Giroux et al. | |
| 2012/0160522 | A1* | 6/2012 | Burgos | E21B 33/1293 166/387 |

* cited by examiner

INCREASED LOAD BEARING THICKNESS FOR ANCHORING SLIP

FIELD OF THE INVENTION

The field of the invention is anchoring slips to support subterranean tools at desired locations and more particularly slip designs that have a reduced thickness for minimizing drift dimension for running in and increased interacting components for enhanced load capacity when set.

BACKGROUND OF THE INVENTION

As the temperatures and pressures of well completions continue to increase, the hanging performance ratings for liner hangers and hold down slips will have to be improved to meet customer requirements and stay competitive in the high pressure high temperature market. One area of improvement for these anchoring systems is to improve the hanging capacity of the slip. Current liner hanger and hold down slips are machined as a single component resulting in a constant slip thickness. The slip thickness dictates the amount of radial overlap (bearing area) between the slip and slip seat when the slips are set downhole. Thus, the slip thickness limits the hanging performance of the anchor system. The slip thickness is limited by the drift requirements of the wellbore and by the body outside diameter needed to meet the pressure and tensile ratings. This prevents the improvement of hanging performance by simply increasing slip thickness. To improve the hanging performance of the slips, the proposed invention comprises a novel slip design that allows the effective slip thickness to be increased down hole. The increased effective thickness will increase the available bearing area improving the hanging performance of the slip. The simplest embodiment is a segmented slip design. Here the slip is comprised of multiple segments whose thickness meets the drift requirements when retracted for running in the hole, and when the down hole position is reached the effective thickness is increased by compressing the segments together. In addition to improving the hanging capacity, the proposed invention will allow for greater radial expansion of the slips.

In the past some of the slip designs have tried to extend the reach of a slip by using a combination of ramps as illustrated in U.S. Pat. Nos. 3,420,306 and 7,431,096. However, simply sliding a slip on a plurality of slopes to get enhanced radial extension does not increase the slip holding capacity as the ramps are not interlocking to function as a unitary structure so that the effective thickness of the slip itself is not effectively increased for additional carrying capacity. A traditional slip moving up a ramp is illustrated in U.S. Pat. No. 3,530,934.

Those skilled in the art will appreciate that the slip design of the present invention allows the slip assembly to articulate in a manner where the segments overlap each other while interlocking in a manner to effectively increase the slip thickness for enhanced load capacity while keeping the drift dimension of the tool sufficiently small for running in so that the tool can be rapidly deployed at the desired location. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A slip design has segments that move relatively axially before moving in tandem up a ramp for radial extension.

Due to the fact of the relative movement the segments interlock due to their geometric configuration or their surface treatment such that at the conclusion of such relative movement the load carrying thickness is effectively increased. The extended position minimizes radial extension of the slips for a smaller tool drift dimension while still allowing the needed radial extension and actually extending the radial reach of the slip assembly. The segment can have triangular or trapezoidal tapered interfaces that provide bearing areas between slip segments and adjacent spacer segment. Alternatively, the slips segments can have opposing wickers so that after riding up an underlying support member can interact with that member for load transfer. The supporting members can also be secured to an underlying mandrel for further load transfer.

DETAILED DESCRIPTION OF THE PREFERRED EMBODIMENT

Figure 1:
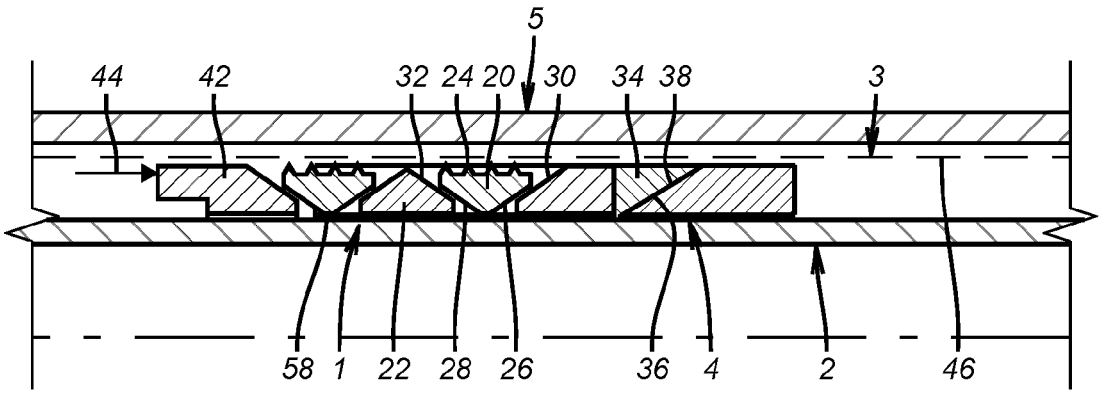
FIG. 1 is a section view in the run in position of a first embodiment of the invention.
Figure 2:
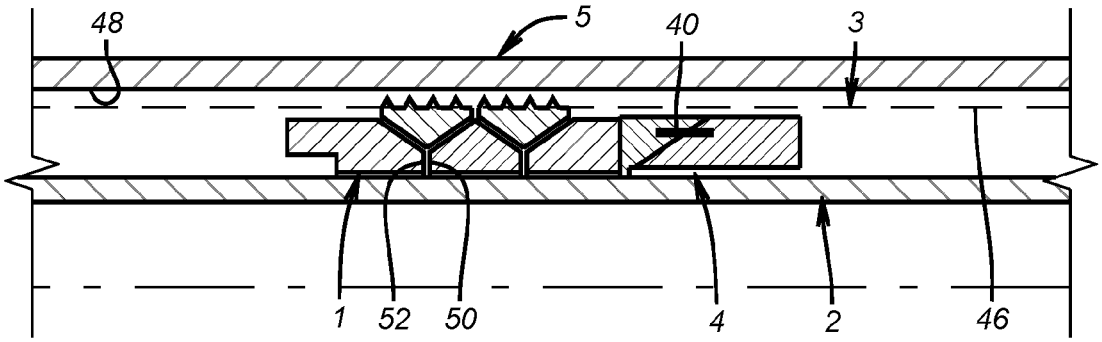
FIG. 2 is the view of FIG. 1 with the slip assembly compressed axially but still not radially extended into the surrounding tubular.

FIG. 1 illustrates an array of slip segments referred to generally as 1 that further comprises gripping segments 20 alternating with supporting segments 22. Gripping segments 20 have exterior wickers 24 and opposed tapered sides 26 and 28. Supporting segments 22 have opposed tapered surfaces 30 and 32 that respectively engage surfaces 26 and 28 for sliding engagement. End segment 34 has a ramp 36 that rides on ramp 38 of slip pocket 4. A shear pin 40 shown in FIG. 2 is still intact after relative axial movement of the driven segment 42 that is driven by mechanical or other force in a known manner and is schematically represented by arrow 44. The desired motion sequence is that supporting segments 22 first move axially closer together to the FIG. 2 position with no movement up the ramp 38 which means the shear pin or pins 40 stay intact. In going from the position of FIG. 1 to the FIG. 2 position, the wickers 24 move from within the drift dimension line 46 to across that line but without contacting the inner wall 48 of the casing 5. However, in the FIG. 2 position opposed surfaces 50 and 52 of adjacent segments 22 come into full contact to this limit the axial contraction of the assembly of segments 20 and 22. In transitioning from the FIG. 2 to the FIG. 3 position, the wickers 24 engage inner wall 48 due to further axial force indicated by arrow 44 breaking the shear pin(s) 40 so that the fully compressed assembly moves in tandem as a unit up the ramp 38. Those skilled in the art will appreciate that in the FIG. 3 position there is a radial overlap among the segments to the extent of arrow 54 such that the effective thickness of the slip assembly is in effect dimension 56 as the segments 20 and 22 act as a unitary assembly for the purposes of supporting loads from the wall 48 of casing 5. In climbing the ramp 38 the segments 20 and 22 can climb away from the body 2. This design is to be contrasted with prior designs where the slip simply climbs on an intermediate member that in turn rides up the cone to simply gain further radial extension without any measurable gain in carrying capacity. It is the radial overlapping of segments in the FIGS. 1-3 design that can not only enhance the radial extension of the gripping segments 20 by at least 30% but can also enhance the load capacity of the assembly by at least 39% compared to known slip up ramp designs described above. In the FIGS. 1-3 design the segments 20 have v-shaped opposed tapered walls 26 and 28 with an apex 58 in between. The apex locates the axial travel limit of the supporting segments 22 as opposed surfaces 50 and 52 come into contact in alignment with apex 58. Increasing the dimension of the slip pocket 4 can also help in enhancing the load capacity of the assembly as long as the outer dimension is within the drift diameter 46.

Figure 3:
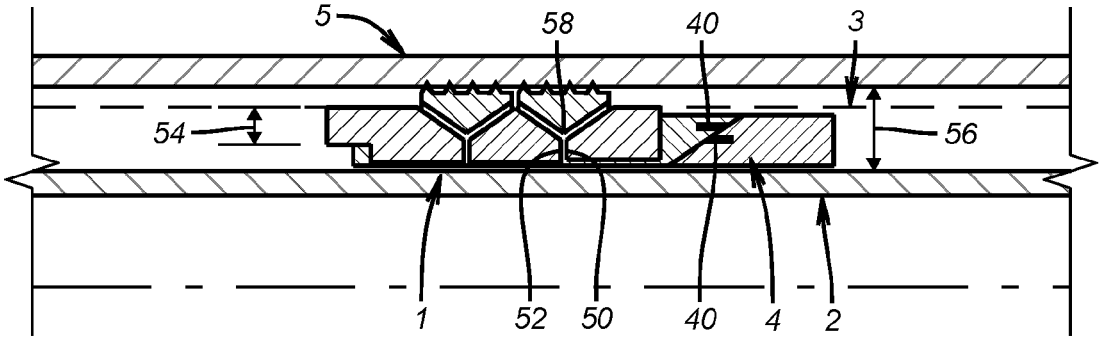
FIG. 3 is the view of FIG. 2 with the axially compressed assembly driven up a ramp to move out radially to engage a surrounding tubular.
Figure 4:
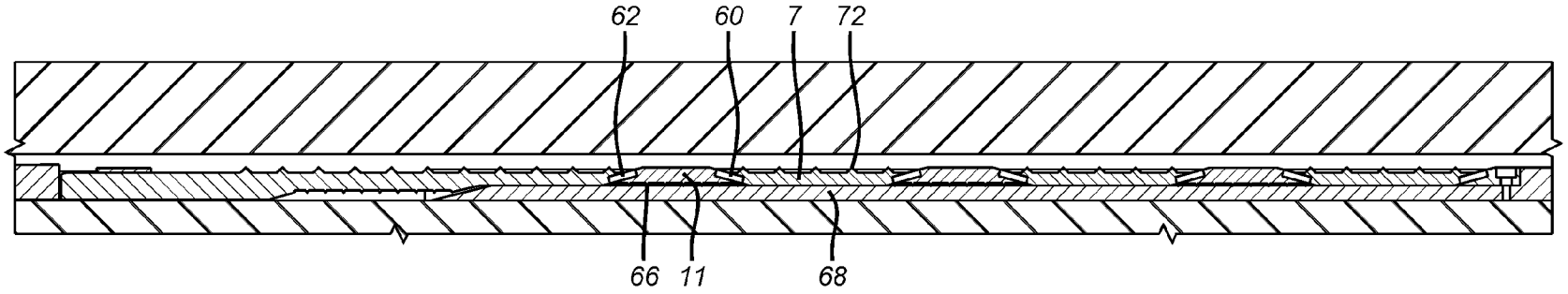
FIG. 4 is a section view of a run in position of a second embodiment of the present invention.
Figure 5:
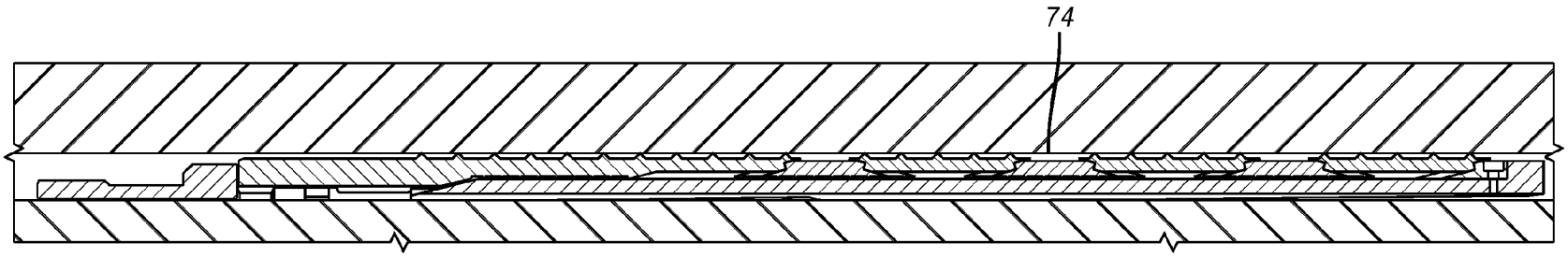
FIG. 5 is the view of FIG. 4 in the set position.
Figure 9:
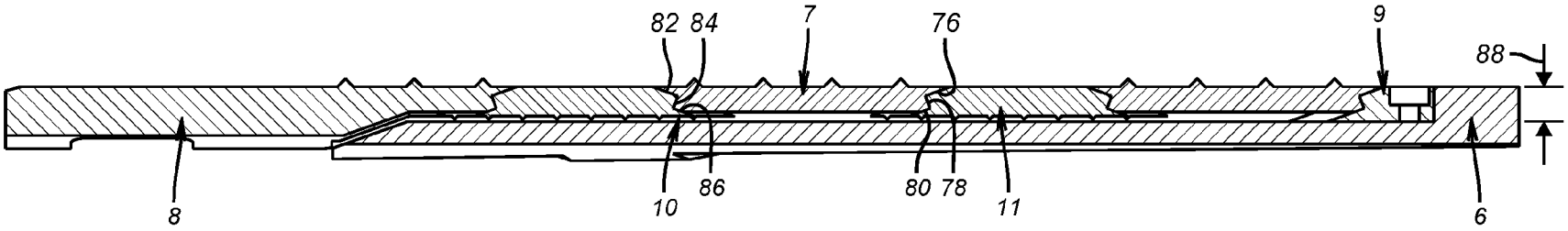
FIG. 9 is the view of FIG. 5 in closer detail.
Figure 10:
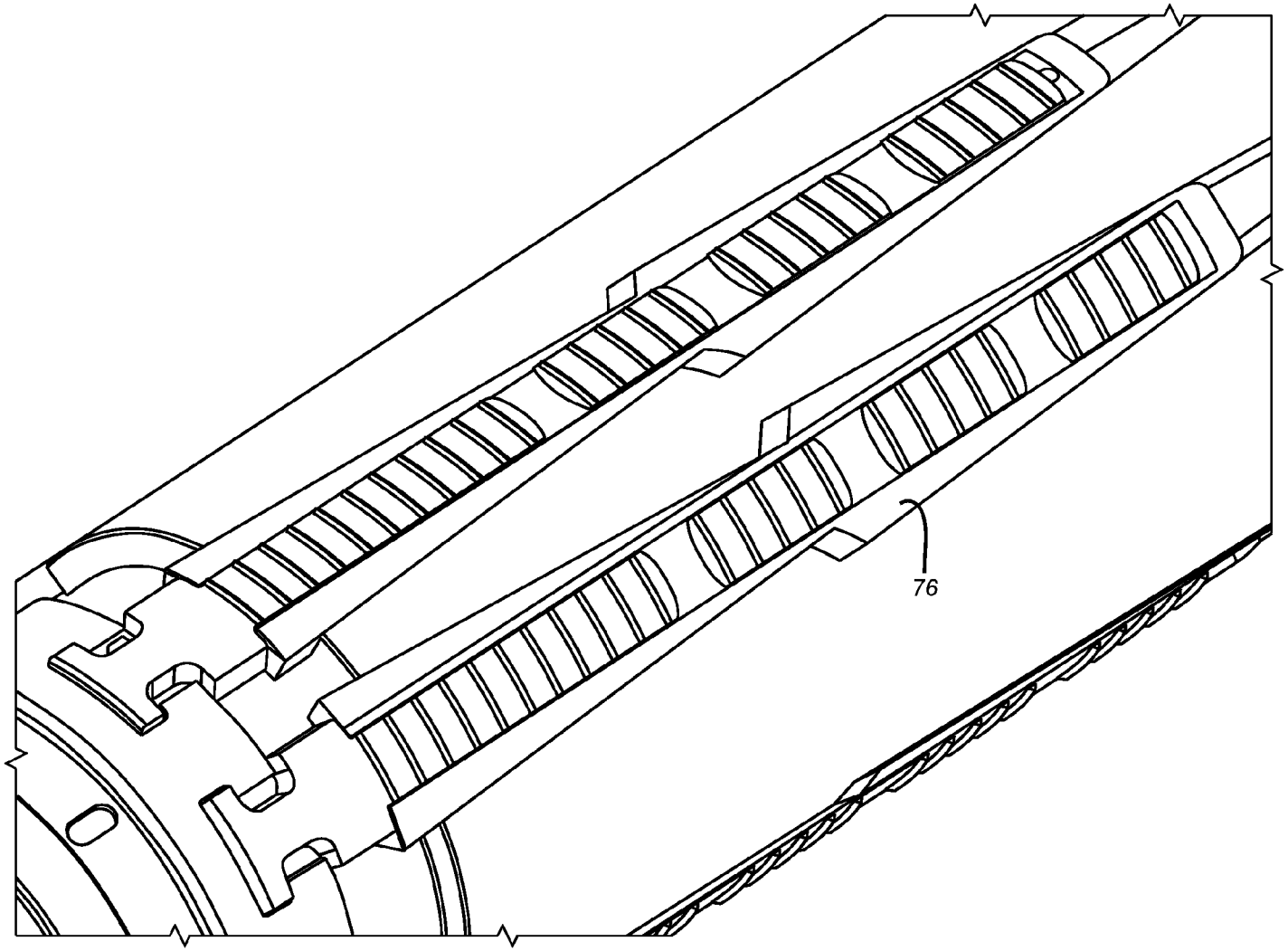
FIG. 10 is a perspective view of FIG. 5 in the set position.

Referring now to FIGS. 4, 5 and 9 there is a variation on the embodiment of FIGS. 1-3. The principle of operation is the same but the segment shapes are slightly different. FIG. 9 shows in greater magnification the support or lower segments 11 that have opposed ramps 60 and 62 and a bottom set of wickers 66. Grip or upper segments 7 have wickers 72 that bite into tubular 74 as shown in FIG. 5. FIG. 10 illustrates the side guide rails that keep segments 7 and 11 aligned as they move relatively in the axial direction. In this embodiment the axial relative movement is facilitated by the climbing of the segments 7 up the ramps 60 and 62 while providing a reaction force that drives the segments 11 into the carrier slip 68 (alternatively to the body or mandrel) where wickers 66 can then penetrate for additional anchoring. In the FIG. 9 position the ramps 60 and 62 can no longer be seen but the multifaceted contact surfaces can be better seen. These surfaces define the outward radial travel limit of the segments 7 with respect to the alternating segments 11. Segments 7 have end surfaces 76, 78 and 80 that engage on opposed ends surfaces 82, 84 and 86 of segments 11 in effect making the assembly an integrally functioning unit of enhanced thickness for grater load carrying capability. The operation for setting involves advancing pusher segment 8 by known means toward front segment 9 that is supported in a stationary position by carrier slip 6. In the preferred arrangement the surfaces 76 and 78 are perpendicular as are surfaces 78 and 80 to present a zig-zag pattern viewed in section in FIG. 9. Again the edge retention system 76 works with the various described embodiments in a known way to hold the segment assembly together while allowing the needed radial movement to take place to advance the components to the set position. Outward movement of the segments 7 stops in the position that is illustrated in FIG. 9.

Further with regard to FIG. 9 a carrier slip 6 is utilized as the primary interface between the segmented slip and the slip pocket. The slip segments are located on the carrier slip 6. For running in the hole the slip segments are pulled apart which draws the upper segments 7 down onto the carrier slip 6 hiding the wicker profile in the carrier slip 6 and below drift. When the slip is in position downhole, the pusher segment 8 is compressed against the front segment 9 until the slip segments contact the mating shoulder 10. This action cams the upper segments 7 out radially and moves the lower segments 11 to support the upper segments 7. The amount of radial expansion acquired by compression of the segments is controlled by the location of the mating shoulder 10. When compression of the segments is complete, the slip segment and the carrier slip 6 act together as a single conventional slip but with an increased effective thickness improving slip performance. The hanging performance of this embodiment may be limited by the bearing area between the pusher 8 and front segments 9 with the carrier slip 6. To more evenly transfer the hanging load into the carrier slip 6 a wicker profile is machined on the bottom of the lower segments 11 allowing the lower segments to bite into the carrier slip 6 and transfer hanging load along the length of the carrier slip 6. Similar to the segmented slip embodiment of FIGS. 1-3, this embodiment requires a mating mechanism between the slip segments that prevents disengagement during running in the hole and properly guides compression of the segments. This mechanism could be of machined rails and mating channels between the segments. Also, a mechanism such as a shear screw or shear ring is needed to ensure the slip segments 1 are fully compressed before setting the slip segments and carrier slip 6 up the slip pocket and into the casing. Calculation shows a 30% radial expansion increase and a 39% increase in hanging capacity over the current known designs.

Figure 6:
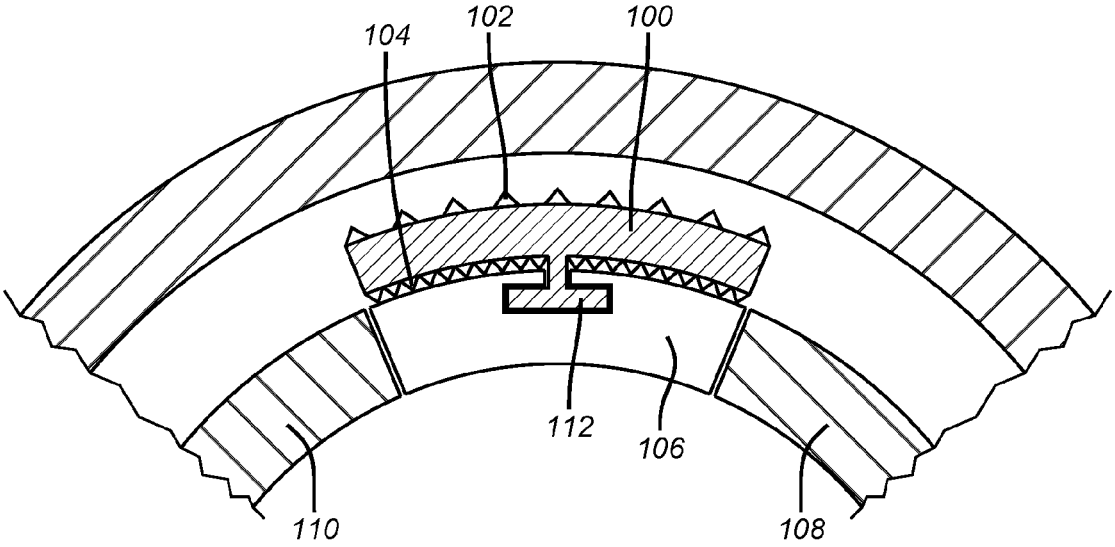
FIG. 6 is a section view of a third embodiment showing a slip with wickers on opposed sides to ride up over an underlying member and functionally interact with the underlying member for enhanced load capacity.

FIG. 6 illustrates another embodiment where the gripping slips 100 have exterior wickers 102 and interior wickers 104. The interior wickers 104 can slide on support segments 106 that can be stationary or that can also be ramped out due to relative axial movement as between the segments 106 and adjoining segments 108 and 110 that define an underlying support ring. This type of axially relatively movable segments that change dimension is a known design of swages for tubular expansion. The gripping slips 100 can be dovetailed to the segments 106 in a manner that still allows some relative axial movement to let the segments 100 contact the surrounding tubular so that wickers 102 can dig into that tubular while at the same time the reaction force can force wickers 104 into penetrating contact with segments 106. One such form of interlocking segments 100 and 106 is to use a T-shaped dovetail as illustrated in FIG. 6. As a result of the wickers 104 digging into the segments 106 the load carrying capacity of the segments 100 is enhanced along the lines discussed above for the other embodiments as the effective thickness is increased to the combined thicknesses of the overlapping segments 100 and 106 now held together with wickers 104. Optionally the exterior surface of the segments 106 facing segments 100 can also have wickers.

Figure 7:
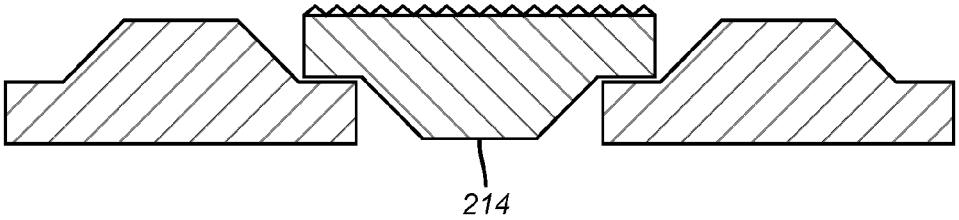
FIG. 7 is a variation of the embodiment in FIG. 4 showing the underlying segments in the run in position.
Figure 8:
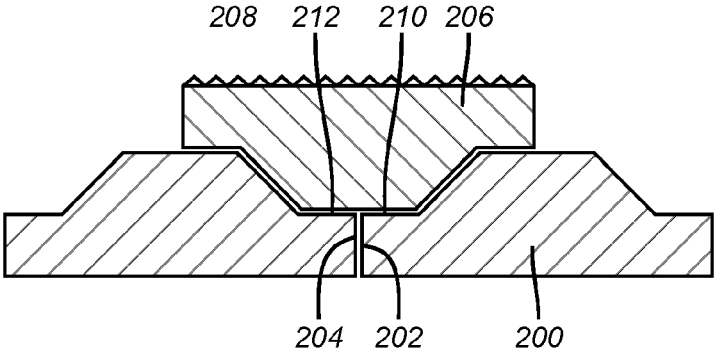
FIG. 8 is the view of FIG. 7 with the abutting of the underlying segments showing the set position.

FIGS. 7 and 8 are a slight variation from the FIGS. 1-3 embodiment where the support segments 200 have abutting surfaces 202 and 204 that push out the grip segments 206 to get wickers 208 to penetrate a surrounding tubular. Segments 200 have adjacent cylindrical surfaces 210 and 212 adjacent surfaces 202 and 204 respectively such that in the set position a bottom surface 214 straddles surfaces 210 and 212 as shown in FIG. 8. In essence the grip segments 206 have an interior trapezoidal shape when viewed in section from the side as in FIGS. 7 and 8.

Those skilled in the art will now appreciate that the present invention that features a slip assembly with relatively movable components allows a low profile for running in where the initial position of the gripping slips is at or near the mandrel and the set position has the gripping slips moving out radially in response to an axial compressive force on the assembly that shortens the assembly and provides an enhanced load bearing capacity to the assembly.

In essence the radial movement of the segments up edge ramps of support segments that flank them locks them together against axial shear forces from loading so that the segments are in effect interlocked when holding such loading by virtue of a series of opposed tapered surface pairs as between the gripping and the support segments. Alternatively, the gripping slips can have internal wickers that allow them to extend to grip the surrounding tubular and at the same time to penetrate the supporting segment that is between the slip segment and a mandrel to allow the combined structures of the gripping slip and its supporting segment to act as unit to enhance the holding capacity of the assembly in the set position by about 40 percent to slip designs that simply ride up a ramp to contact the surrounding tubular. The supporting segments in this latter embodiment can be stationary or radially movable. The grip segments can be dovetailed to the support segments when initially overlaid for the run in position. In this variation the segments can be simply circumferentially offset rather than an axial stack of interactive segments as in FIGS. 1-5 and 7-9.

The above description is illustrative of the preferred embodiment and many modifications may be made by those skilled in the art without departing from the invention whose scope is to be determined from the literal and equivalent scope of the claims below:

I claim:

1. An articulated slip assembly, comprising:

a mandrel;

axially alternating gripping segments and support segments configured in a first position where said gripping and support segments are located by said mandrel and a set position where said support segments have each moved axially and toward each other and radially displaced said gripping segments into engagement with a surrounding tubular to support loads transmitted to said mandrel.

2. The assembly of claim 1, wherein:

said radial movement of said gripping segments results from a camming force of tapered surfaces on said support segments creating a radial force component on mating tapered surfaces of said gripping components in response to axial movement of said support segments.

3. The assembly of claim 2, wherein:

said tapered surfaces on said gripping members end in a spaced relation to each other to define a cylindrical surface.

4. The assembly of claim 1, wherein:

axial movement of said support segments to a point of contact with each other does not result in engagement of said gripping components of a surrounding tubular.

5. An articulated slip assembly, comprising:

a mandrel;

alternating gripping segments and support segments configured in a first position where said gripping and support segments are located by said mandrel and a set position where said support segments have moved axially toward each other and radially displaced said gripping segments into engagement with a surrounding tubular to support loads transmitted to said mandrel;

axial movement of said support segments to a point of contact does not result in engagement of said gripping components of a surrounding tubular;

said gripping and support segments move in tandem upon contact of said support segments with each other.

6. The assembly of claim 5, further comprising:

a ramp to push out said support and gripping segments together once said support segments have contacted each other.

7. The assembly of claim 6, wherein:

a breakable member operably engaged to at least one of said segments to order segment movement into an initial axial movement to allow said support segments to move into contact from axial movement before the assembly of said segments is moved radially by movement along said ramp.

8. The assembly of claim 7, wherein:

said breakable member is at least one shear pin.

9. The assembly of claim 6, wherein:

said ramp is independent of said segments.

10. The assembly of claim 6, wherein:

said ramp comprises opposing axially spaced end ramps on each of said support segments.

11. The assembly of claim 10, wherein:

said gripping segments comprise a plurality of stop surfaces that engage an opposed plurality of stop surfaces on opposing support segments that flank said gripping segments to define the end of travel of said gripping segments on said axially spaced end ramps on each of said support segments.

12. The assembly of claim 11, wherein:

said plurality of surfaces present a zig-zag pattern in an end section view.

13. The assembly of claim 12, wherein:

at least two adjoining surfaces of said zig-zag pattern are disposed perpendicularly to each other.

14. An articulated slip assembly, comprising:

a mandrel;

alternating gripping segments and support segments configured in a first position where said gripping and support segments are located by said mandrel and a set position where said support segments have moved axially toward each other and radially displaced said gripping segments into engagement with a surrounding tubular to support loads transmitted to said mandrel;

said radial movement of said gripping segments results from a camming force of tapered surfaces on said support segments creating a radial force component on mating tapered surfaces of said gripping components in response to axial movement of said support segments;

said tapered surfaces meet at an apex.

15. An articulated slip assembly, comprising:

a mandrel;

alternating gripping segments and support segments configured in a first position where said gripping and support segments are located by said mandrel and a set position where said support segments have moved axially toward each other and radially displaced said gripping segments into engagement with a surrounding tubular to support loads transmitted to said mandrel;

said radial movement of said gripping segments results from a camming force of tapered surfaces on said support segments creating a radial force component on mating tapered surfaces of said gripping components in response to axial movement of said support segments;

said tapered surfaces on said gripping members end in a spaced relation to each other to define a cylindrical surface;

supporting segments that have moved axially into each other define adjacent cylindrical surfaces to abut the cylindrical surface on an opposing gripping member.

16. A slip assembly for support of a tool at a subterranean location comprising:

a mandrel:

a plurality of support segments pushed in the same direction relatively to said mandrel;

a plurality of axially spaced gripping segments flanked on opposed sides with said support segments to create an axially oriented alternating arrangement of said support segments and said gripping segments, said support segments axially slidably movable relative to said gripping segments therebetween while in contact with said gripping segments, said axial relative movement moving said gripping segments into a penetrating gripping engagement with a surrounding tubular.

17. The assembly of claim 16, wherein: said gripping segments are secured to associated said support segments with a dovetail that permits said relative axial movement therebetween.

18. The assembly of claim 16, wherein:

said support segments are selectively radially articulated.

19. The assembly of claim 18, wherein:

said support segments are a part of a ring structure of relatively axially movable members whose relative axial movement creates a radially outward movement for said support segments.

20. The assembly of claim 16, wherein:

said support segments comprise wickers on radially opposed sides thereof.

* * * * *